US005597986A

United States Patent [19]

Harwood et al.

[11] Patent Number: 5,597,986

[45] Date of Patent: Jan. 28, 1997

[54] STAMP FORMED MUFFLER WITH NESTED CHAMBERS

[75] Inventors: Jon W. Harwood, Toledo; Bennie A. Van Blaircum, Whitehouse, both of Ohio

[73] Assignee: AP Parts Manufacturing Company, Toledo, Ohio

[21] Appl. No.: 395,049

[22] Filed: Feb. 27, 1995

[51] Int. Cl.[6] ..... F01N 7/18

[52] U.S. Cl. ..... 181/282; 181/272; 181/276

[58] Field of Search ..... 181/282, 265, 181/266, 269, 272, 276

[56] References Cited

U.S. PATENT DOCUMENTS

| | | | |
|---|---|---|---|
| 2,484,827 | 10/1949 | Harley . | |
| 2,902,109 | 9/1959 | Burgess et al. . | |
| 3,125,182 | 3/1964 | Earley . | |
| 3,140,755 | 7/1964 | Tranel . | |
| 3,158,222 | 11/1964 | Richmond . | |
| 3,176,791 | 4/1965 | Betts et al. . | |
| 3,198,284 | 8/1965 | Powers . | |
| 3,220,508 | 11/1965 | Nordquest et al. . | |
| 3,638,756 | 2/1972 | Thiele | 181/282 |
| 3,709,320 | 1/1973 | Holleri et al. . | |
| 3,827,529 | 8/1974 | Frietzsche et al. . | |
| 4,132,286 | 1/1979 | Hasui | 181/265 |
| 4,396,090 | 8/1983 | Wolfhugel | 181/282 |
| 4,415,059 | 11/1983 | Hayashi | 181/250 |
| 4,456,091 | 6/1984 | Blanchot | 181/282 |
| 4,700,806 | 10/1987 | Harwood | 181/282 |
| 4,736,817 | 4/1988 | Harwood | 181/282 |
| 4,759,423 | 7/1988 | Harwood et al. | 181/282 |
| 4,760,894 | 8/1988 | Harwood et al. | 181/282 |
| 4,765,437 | 8/1988 | Harwood et al. | 181/282 |
| 4,836,330 | 6/1989 | Harwood et al. | 181/282 |
| 4,860,853 | 8/1989 | Moring, III | 181/282 |
| 4,894,987 | 1/1990 | Harwood et al. | 181/282 |
| 4,901,815 | 2/1990 | Harwood et al. | 181/282 |
| 4,901,816 | 2/1990 | Garey . | |
| 4,905,791 | 3/1990 | Garey | 181/282 |
| 4,909,348 | 3/1990 | Harwood et al. | 181/282 |
| 4,928,372 | 5/1990 | Harwood et al. . | |
| 4,941,545 | 7/1990 | Wilcox et al. . | |
| 4,958,701 | 9/1990 | Moring, III | 181/282 |
| 5,004,069 | 4/1991 | Van Blaircum et al. . | |
| 5,012,891 | 5/1991 | Macaluso | 181/282 |
| 5,042,125 | 8/1991 | Harwood et al. . | |
| 5,164,551 | 11/1992 | Harwood et al. . | |
| 5,173,577 | 12/1992 | Clegg et al. . | |
| 5,252,788 | 10/1993 | Emrick et al. . | |

FOREIGN PATENT DOCUMENTS

| | | |
|---|---|---|
| 59-155528 | 9/1984 | Japan . |
| 59-43456 | 12/1984 | Japan . |
| 61-14565 | 5/1986 | Japan . |
| 632013 | 1/1950 | United Kingdom . |
| 1012463 | 12/1965 | United Kingdom . |
| 2120318 | 11/1983 | United Kingdom . |

*Primary Examiner*—Khanh Dang

*Attorney, Agent, or Firm*—Anthony J. Casella; Gerald E. Hespos

[57] ABSTRACT

A stamp formed muffler includes a first plate, a second plate and at least one sheet. A second plate and the sheet are secured in face-to-face relationship with the first plate and define a plurality of tubes and an internal chamber. External shells are secured around the internal plates to enclose the tubes and the internal chamber. The external shell may be formed to engage the internal chamber such that the internal chamber divides the external shell into upstream and downstream chambers.

23 Claims, 5 Drawing Sheets

STAMP FORMED MUFFLER WITH NESTED CHAMBERS

BACKGROUND OF THE INVENTION

1. Field of the Invention

The subject invention relates to an exhaust muffler manufactured from formed components. The muffler provides several acoustical tuning options for efficiently attenuating the noise associated with the flow of exhaust gas.

2. Description of the Prior Art

The most commonly used prior art exhaust muffler includes a plurality of separate parallel tubes that are supported by transversely extending planar baffles of oval or circular shape. The assembly of tubes and baffles is slid into a tubular shell that has a cross-sectional configuration conforming to the shape of the baffles. An outer wrapper may be wrapped around the shell for additional strength and noise insulation. Opposed end caps or headers are then mechanically connected to the opposed ends of the shell and wrapper to enclose the muffler. Each end cap includes an aperture to define an inlet to or outlet from the muffler. With this construction, chambers are defined within the prior art muffler between adjacent baffles or between a baffle and an end cap. Each chamber is enclosed by the tubular outer shell. Some of the tubes in the prior art muffler may terminate in a chamber. Others will pass entirely through a chamber. Portions of tubes in certain chambers will have louvers or perforations to permit gas communication between the tube and the surrounding chamber.

Exhaust gas in the above described prior art muffler flows from tubes into the surrounding chambers and from the chambers into other tubes. The particular pattern of exhaust gas flow will vary from one muffler design to another. However, many prior art mufflers utilize a tri-flow pattern. Exhaust gas enters the upstream end of a tri-flow muffler and flows to a reversing chamber near the opposed downstream end. The exhaust gas then undergoes a substantially 180° change in direction and flows back toward the upstream end of the muffler to a second reversing chamber. The exhaust gas then undergoes a second 180° change in direction and continues from the second reversing chamber to the outlet at the downstream end of the muffler. Perforated portions of the tubes pass through expansion chambers in the prior art muffler to permit expansion and cross flow of exhaust gas and to achieve attenuation of a major portion of the noise. Some non-perforated tubes may dead end into an enclosed Helmholz chamber to attenuate any narrow range of low frequency noise that is not adequately attenuated by the expansion chamber. The acoustical performance of this prior art muffler can be changed considerably by varying the dimensions of the tubes and chambers and by changing the size and locations of apertures, louvers or the like.

The above described prior art muffler is effective in attenuating noise. However, these prior art mufflers require a large number of separate components that must be assembled in a labor intensive manufacturing process. Furthermore, the abrupt edges of the tubes and the right angle alignment of the outer shell to the baffles, contribute to turbulence and back pressure that can impede engine performance.

The prior art also includes mufflers made entirely or substantially from formed sheets of metal. Very effective prior art formed mufflers are shown in patents assigned to the assignee of the subject invention. Most of these prior art formed mufflers include a pair of plates that are stamp formed with channels. The plates are secured in opposed face-to-face relationship, such that the channels define gas passages or tubes between the plates. These prior art stamp formed mufflers further include at least one external shell secured to at least one of the plates to define at least one chamber surrounding the gas passages or tubes formed by the plates. The tubes may be perforated to provide gas communication with the chambers defined by the external shell. These prior art stamp formed mufflers are shown in U.S. Pat. No. RE 33,370 and Reexamined U.S. Pat. No. 4,736,817.

Further improvements to stamp formed mufflers are shown in U.S. Pat. No. 5,252,788 which also is assigned to the assignee of the subject invention. The plates of the muffler shown in U.S. Pat. No. 5,252,788 are formed to define tubes and to further define an in-line chamber. The in-line chamber is bridged by a conventional tube disposed at a central location between the respective sides of the muffler. Exhaust gas entering this prior art muffler will flow through a formed inlet tube and will expand into the in-line chamber formed between the plates. The exhaust gas will then flow around opposite respective sides of the conventional tube and will expand a second time into portions of the in-line chamber downstream from the conventional tube. The exhaust gas will then enter a formed flow tube that communicates with the in-line chamber. The flow tube may be perforated or louvered to permit expansion of exhaust gas into a chamber defined by the external shell. The exhaust gas will continue into a second flow tube which communicates with the conventional tube that bridges the in-line chamber. Exhaust gas will continue through the conventional tube and toward the outlet of this prior art muffler. The in-line chamber formed by the plates extends into contact with the external shell of the muffler shown in U.S. Pat. No. 5,252,788. Thus, the in-line chamber can effectively function as a baffle between spaced apart chambers defined by the external shell.

The muffler shown in U.S. Pat. No. 5,252,788 has proved to be very effective and has been widely commercialized. However, it is desirable to provide even more tuning options in a muffler.

It is also be desirable to provide a muffler made entirely from formed components and having enhanced acoustical tuning capabilities.

SUMMARY OF THE INVENTION

The subject invention is directed to a muffler manufactured from formed sheets of metal. Each sheet preferably is formed by stamping. However, metal forming techniques that rely upon hydraulic forces, magnetic forces and/or explosive forces also can be used for manufacturing at least certain of the components of the muffler.

The muffler of the subject invention includes first and second plates formed to define a plurality of channels. The plates are secured in face-to-face relationship such that the channels define tubes. Channels in one plate preferably register with channels in the other plate, but extend in opposite directions. Thus tubes of generally oval or circular cross-sectional shape are defined. At least two tubes extend to the periphery of the plates and define at least one inlet and at least one outlet for the muffler. Selected portions of the formed tubes are provided with aperture means for permitting communication of exhaust gas between the tubes and surrounding regions of the muffler.

The muffler further includes a formed sheet secured to the first plate. The sheet and the plates are formed to define an internal chamber with a plurality of formed tubes passing therethrough. At least one tube passing through the internal chamber includes aperture means for permitting communication of exhaust gas between the internal chamber and the formed tubes passing therethrough. Tubes passing through the internal chamber communicate with other tubes formed by the first and second plates, and hence also communicate with the inlet and outlet of the muffler. In preferred embodiments, as explained further herein, first and second formed sheets are secured respectively to the first and second plates to define an internal chamber that surrounds tubes passing therethrough.

The relationship of the formed sheets and the plates relative to one another may differ from one embodiment of the muffler to the next. For example, the internal chamber may be formed by the plates. In this embodiment, the sheets may be secured in face-to-face relationship with one another and may be formed to define a plurality of tubes therebetween. These interconnected sheets define a flow channelizing insert that may be secured between the plates of the muffler to bridge the internal chamber formed by the plates. Selected tubes of the insert may be provided with aperture means for permitting communication of exhaust gas between the tubes of the insert and the internal chamber defined by the plates.

In an alternate embodiment the sheets may be formed to define the internal chamber of the muffler. The sheets may further be formed to closely surround portions of the tubes defined by the plates. These portions of the internal plates surrounded by the formed sheets may have aperture means for permitting gas communication between the tubes and the internal chamber.

The muffler of the subject invention further includes at least one external shell, and preferably a pair of external shells. The external shell is securely connected to a formed plate and defines at least one chamber that surrounds the tubes formed in the plate. Additionally, portions of the external shell are formed to engage the internal chamber defined either by the corresponding formed plate or the sheet. Thus, the internal chamber forms a baffle which separates chambers defined by the corresponding external shell. The external shell is further formed to define inlet and outlet openings for surrounding the inlet and outlet tubes defined by the plates.

Exhaust gas entering the muffler of the subject invention will flow through an inlet tube defined by the formed plates of the muffler. The exhaust gas will continue through a first tube which bridges the internal chamber. Apertures may be provided for permitting expansion of exhaust gas into the internal chamber. Exhaust gas may next flow into a tube formed by the plates and located downstream of the internal chamber. This downstream tube may include an aperture or perforations to permit exhaust gas to flow into a downstream chamber defined by at least one external shell. A downstream return tube formed by the plates may have communication means for receiving exhaust gas from the downstream chamber and may direct the exhaust gas back through a tube that bridges the internal chamber. Apertures, perforations or the like may permit further gas communication with the internal chamber. Exhaust gas may continue upstream through a tube which includes aperture means for communicating with an upstream chamber defined by the external shell. The upstream chamber may be separated from the downstream chamber by the internal chamber. An upstream return tube formed by the plates may receive exhaust gas from the upstream chamber, and may direct the exhaust gas through the internal chamber, and to an outlet of the muffler.

Considerable variations of this basic design can be provided so that the muffler can be tuned to the acoustical needs of a particular exhaust system. For example, the internal chamber can function as a reversing chamber, and the downstream chamber can function as at least one Helmholz chamber for attenuating selected narrow ranges of low frequency noise. In other embodiments, one external shell and one internal plate may form a Helmholz chamber, while the other external shell and the other plate may form an expansion or reversing chamber. In all such embodiments, the acoustical tuning can be varied by changing the location, size and shape of aperture means in the formed tubes of the plates and the gas passages of the insert.

BRIEF DESCRIPTION 0F THE DRAWINGS

DETAILED DESCRIPTION OF THE PREFERRED EMBODIMENTS

Figure 1:
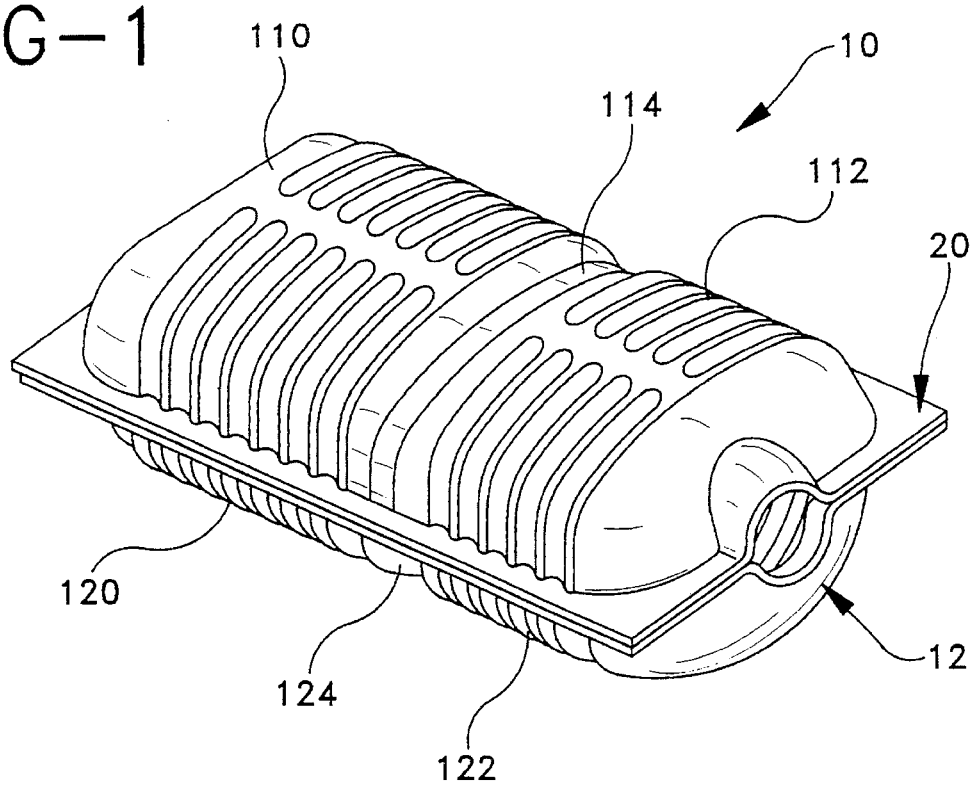
FIG. 1 is a perspective view of a muffler in accordance with the subject invention.
Figure 2:
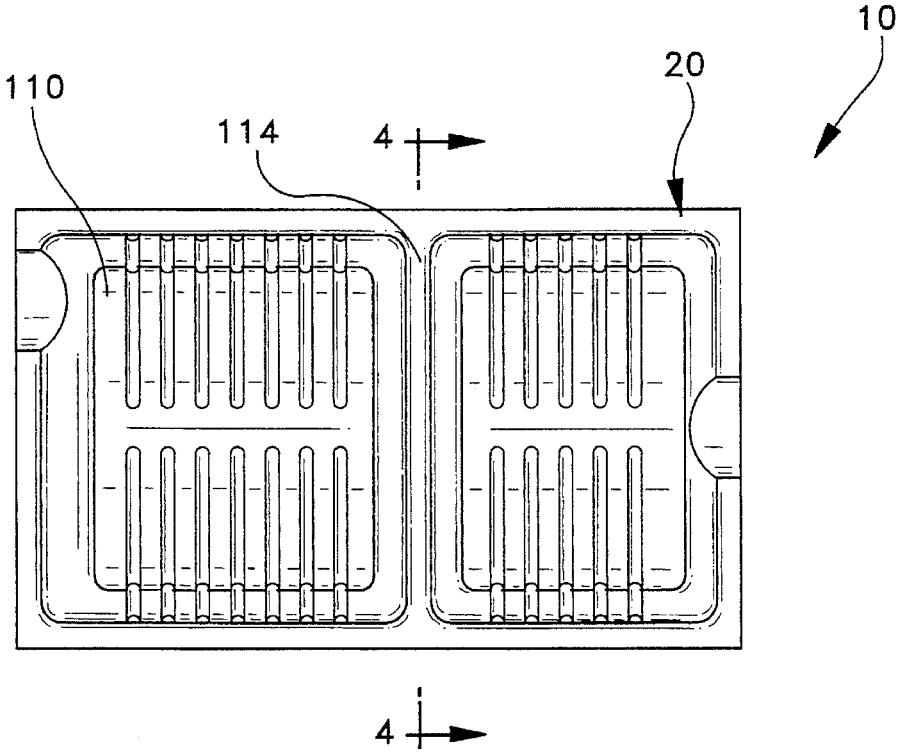
FIG. 2 is a bottom plan view of the muffler shown in FIG. 1.
Figure 3:
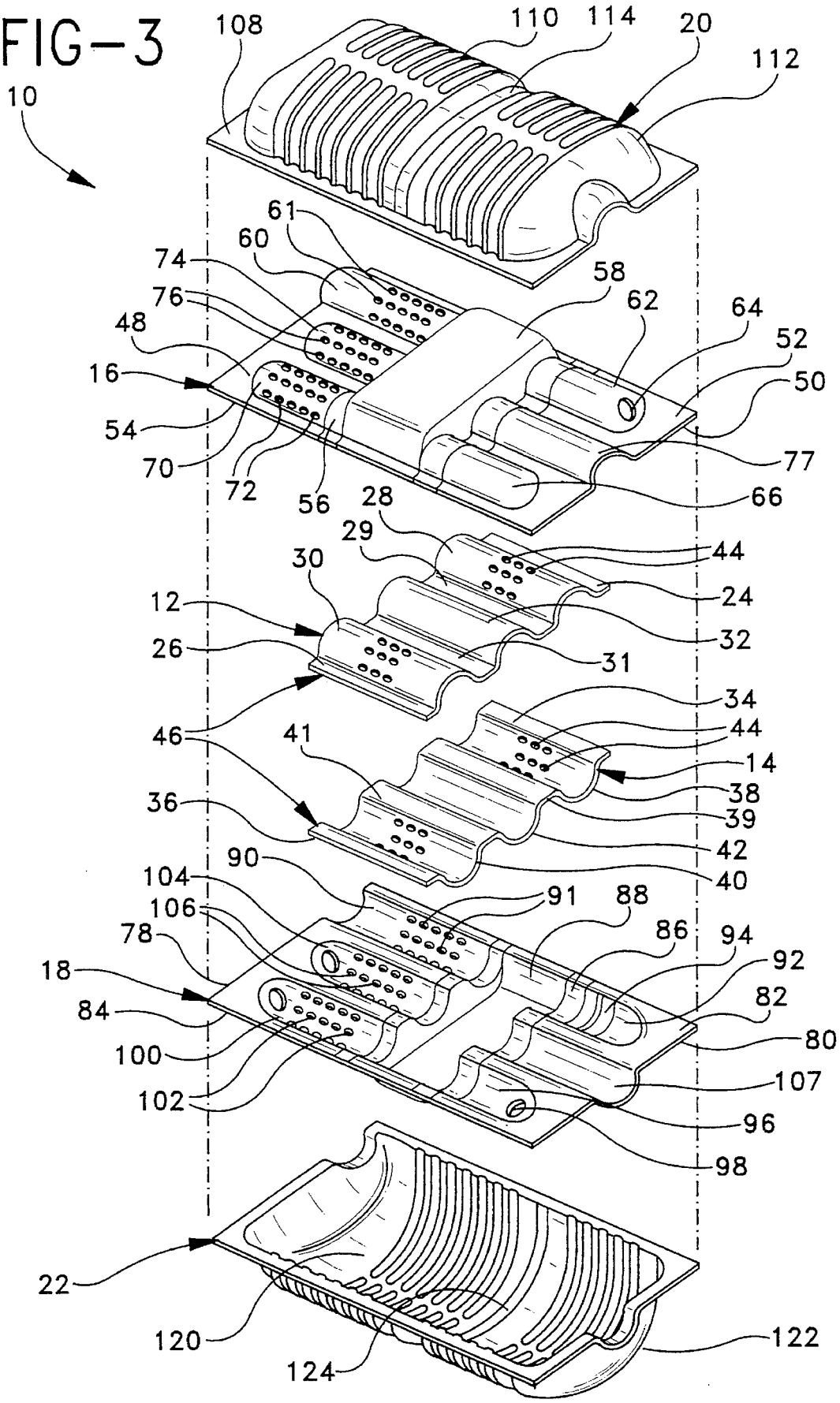
FIG. 3 is an exploded perspective view of the muffler shown in FIG. 1 and 2.
Figure 4:
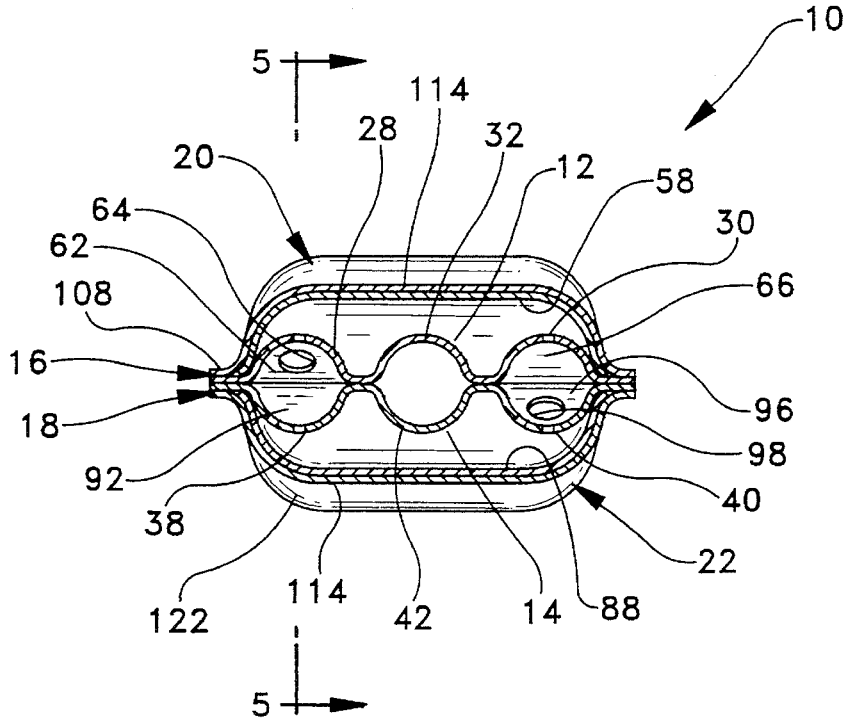
FIG. 4 is a cross-sectional view taken along line 4—4 in FIG. 2.
Figure 5:
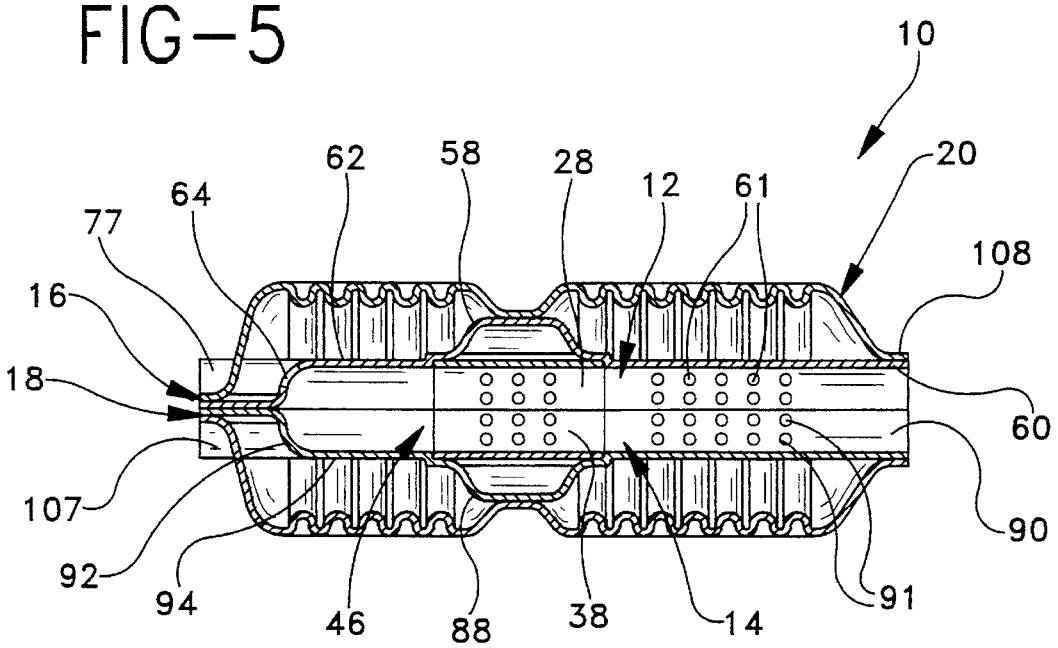
FIG. 5 is a cross-sectional view taken along line 5—5 in FIG. 4.

A muffler in accordance with the subject invention is identified generally by the numeral 10 in FIGS. 1–5. As shown most clearly in FIG. 3, the muffler 10 includes first and second flow channelizing sheets 12 and 14, first and second internal plates 16 and 18 and first and second external shells 20 and 22.

The first and second sheets 12 and 14 are formed by stamp forming, roll forming or other known metal forming techniques to define a plurality of channels. More particularly, the first sheet 12 includes a pair of coplanar peripheral flanges 24 and 26 and first, second and third channels 28, 30 and 32 which are separated from one another by planar portions 29 and 31 respectively. The second sheet 14 similarly is characterized by a pair of coplanar peripheral flanges 34 and 36. First through third parallel channels 38, 40 and 42 are formed in the second sheet 14 between the peripheral flanges 34 and 36, and are separated from one another by planar portions 39 and 41. The channels 38, 40 and 42 of the second sheet 14 are formed to register with the channels 28, 30 and 32 respectively of the first sheet 12. In this registered condition, the coplanar peripheral flanges 24 and 26 of the first sheet 12 will register with the coplanar peripheral flanges 34 and 36 of the second sheet 14. Additionally, the planar portions 29 and 31 of the first sheet will register respectively with the planar portions 39 and 40 of the second sheet.

The first and second sheets 12 and 14 are provided with perforations 44 in the channels 28, 30, 38 and 40. Although the perforations 44 are depicted as being circular apertures, other configurations may be provided to achieve a desired acoustical effect. For example, slots, louvers or large cut-outs may be provided. The channels 32 and 42 of the sheets are free of perforations.

The sheets 12 and 14 are secured to one another to define a tri-flow insert 46. Secure connection of the first sheet 12 to the second sheet 14 may be achieved by welding the peripheral flanges 24 and 26 of the first sheet 12 to the corresponding peripheral flanges 34 and 36 of the second sheet 14. Additionally, spot welds, rivets or crimping may be used to secure the planar portions 29 and 31 of the first sheet 12 to the registered planar portions 39 and 41 of the second sheet 14.

The first internal plate 16 is generally rectangular and includes opposed upstream and downstream ends 48 and 50 and opposed sides 52 and 54. The sides 52 and 54 define a width for the internal plate 16 which exceeds the width of the sheets 12 and 14.

The first internal plate 16 is formed to include an insert seat 56 for receiving the first sheet 12 of the tri-flow insert 46. Portions of the first internal plate 16 within the bounds of the insert seat 56 are formed to define an internal chamber 58 which is cross-sectionally larger than the cross-section of the tri-flow insert 46.

The first internal plate 16 is further formed to define an inlet channel 60 extending from the upstream end 48 into the region defined by the insert seat 56. Apertures 61 are formed in the inlet channel of the first internal plate 16. A downstream tuning channel 62 is generally aligned with the inlet channel 60 and extends from the insert seat 56 toward the downstream end 50. The downstream tuning channel 62 terminates in an aperture 64 for communication with a low frequency resonating chamber as explained below. However, other aperture, such as an array of perforations, louvers or the like, means may be provided for permitting the expansion and/or cross flow of exhaust gas.

A downstream return channel 66 extends from a location near the downstream end 50 of the first internal plate 16 back to the insert seat 56. The downstream return channel 66 is depicted as being free of apertures in this embodiment. However, apertures may be provided in other embodiments for permitting an in-flow of exhaust gas.

An upstream flow channel 70 is generally aligned with the downstream return channel 66 and extends from the insert seat 56 toward the upstream end 48 of the first internal plate 16. The upstream flow channel 70 is characterized by apertures 72 for permitting expansion of exhaust gas. As noted above, other means can be provided for permitting expansion of exhaust gas from the upstream flow channel 70.

An upstream return channel 74 extends from a location near the upstream end 48 of the first internal plate 16 to the insert seat 56. The upstream return channel 74 includes apertures 76 for permitting an in-flow of exhaust gas. An outlet channel 77 is aligned with the upstream return channel 74 and extends from the insert seat 56 to the downstream end 50 of the first internal plate 16. The outlet channel 77 is free of apertures.

The second internal plate 18 is generally a mirror image of the first internal plate 16. More particularly, the second internal plate 18 includes an inlet end 78, an outlet end 80 and opposed sides 82 and 84 which will register with the corresponding ends and sides of the first internal plate 16 upon assembly of the muffler, as explained further herein. The second internal plate 18 further includes an insert seat 86 for receiving the second sheet 14 of the tri-flow insert 46. The insert seat 86 is characterized by an internal chamber 88 which is cross-sectionally larger than the cross-section of the tri-flow insert 46.

The second internal plate 18 includes an inlet channel 90 which extends from the inlet end 78 to the insert seat 86. The inlet channel 90 is disposed to register with the inlet channel 60 of the first internal plate 16. Apertures 91 extend through the inlet channel 90. A downstream flow channel 92 is aligned with the inlet channel 90 and extends from the insert seat 86 toward the downstream end 80 of the second internal plate 18. The downstream flow channel 92 includes an aperture 94 intermediate the length of the channel for permitting expansion of exhaust gas therefrom. The downstream flow channels 62 and 92 of the first and second internal plates 16 and 18 register with one another. However the apertures 64 and 94 are not registered.

A downstream return channel 96 extends from a location near the downstream end 80 of the second internal plate 18 to the insert seat 86. The downstream return channel 96 is characterized by an aperture 98 to permit an in-flow of exhaust gas, and is disposed to register with the corresponding channel 66 of the first internal plate 16.

An upstream flow channel 100 is aligned with the downstream return channel 96 and extends from the insert seat 86 toward the upstream end 78 of the second internal plate 18. The upstream flow channel 100 is characterized by apertures 102 to permit expansion of exhaust gas. An upstream return channel 104 extends from a location near the upstream end 78 of the second internal plate 18 to the insert seat 86. The upstream return channel 104 includes apertures 106 for permitting an in-flow of exhaust gas. The upstream flow channel 100 and the upstream return channel 104 are disposed to register respectively with the channels 70 and 74 of the first internal plate 16.

An outlet channel 107 is aligned with the upstream return channel 104 and extends from the insert seat 86 to the outlet end 80 of the second internal plate 18. The outlet channel 107 is disposed to register with the outlet channel 77 of the first internal plate 16 and is free of apertures.

The first external shell 20 is generally rectangular and includes a peripheral flange 108 dimensioned to register with peripheral regions of the first internal plate 16. The first external shell is formed to include first and second chambers 110 and 112 extending from the peripheral flange 108 and separated from one another by a connecting portion 114. The second external shell 22 includes a peripheral flange 118 disposed to register with the peripheral flange 108 of the first external shell 20. Additionally, the second external shell 22 includes first and second chambers 120 and 122 extending from the peripheral flange 118 and a connecting portion 124 therebetween. The peripheral flanges 108 and 118 of the first and second external shells 20 and 22 are formed with arcuate regions to surround and engage portions of the inlet channels 60, 90 and the outlet channels 77, 107.

The muffler 10 is assembled by securing the sheets 12 and 14 together to define a tri-flow insert 46. The sheets 12 and 14 preferably are connected by welding, but other methods of connection are acceptable. The first and second internal plates 16 and 18 are then secured around the insert 46, such that the insert 46 is securely positioned in the insert seats 56 and 86 of the first and second internal plates 16 and 18 respectively. The first and second internal plates 16 and 18 may be spot welded to one another at locations intermediate the respective channels and may further be spot welded to one end of the insert 46. Securing only one end of the insert 46 permits thermal expansion to occur without damaging the connections or deforming the parts. The insert 46 with the internal plates 16 and 18 sandwiched thereabout may then be placed intermediate the first and second external shells 20 and 22. Selected locations on the connecting portions 114 and 124 of the external shells 20 and 22 may be spot welded to opposed regions of the internal chambers 58 and 88 of the first and second internal plates 16 and 18. The peripheral flanges 108 and 118 of the first and second external shells 20 and 22 may then be laser welded to the peripheral regions of the first and second internal plates 16 and 18. This laser welding preferably defines a continuous integral seam joining the peripheral flanges 108 and 118 and peripheral regions of the first and second internal plates 16 and 18. Other connection techniques may be employed, such as welding with other apparatus or crimping.

In this interconnected state, the channels of the first and second internal plates register with one another to define tubes for carrying exhaust gas. Each of the tubes defined by the internal plates 16 and 18 communicates with the gas passages defined by the channels in the sheets 12 and 14 defining the tri-flow insert 46. Additionally, the gas passages defined by the tri-flow insert all bridge the internal chamber 58, 88 formed by the internal plates 16 and 18 to provide communication between the aligned tubes on opposite sides of the insert seats 56, 86. Additionally, in this interconnected state, the external chambers 110, 120, 112 and 122 of the external shells 20 and 22 surround portions of the tubes defined by the internal plates 16 and 18. The upstream external chambers 110 and 120 are separated from the downstream external chambers 112 and 122 by the internal chamber 58, 88. Thus, the internal chamber 58, 88 functions as a baffle which separates the upstream and downstream external chambers from one another.

Exhaust gas enters the muffler 10 at the inlet tube defined by the inlet channels 60 and 90 of the internal plates 16 and 18. The exhaust gas continues through the inlet tube and into the first gas passage defined by the first channels 28 and 38 of the insert 46. Some of this exhaust gas in the first gas passage 28, 38 will expand through apertures 44 of the tri-flow insert 46 and into the internal chamber 58, 88. However, a significant portion of the exhaust gas will continue through the tri-flow insert 46 and into the downstream flow tube defined by channels 62 and 92. This exhaust gas will expand through the aperture 94 and into the downstream external chamber 122. Portions of the tube formed by the channels 62 and 92 downstream from the aperture 94 will function as a tuning tube. The tuning tube defined by these downstream ends of channels 62 and 92 will communicate with the downstream external chamber 112 through the aperture 64. Thus, the downstream external chamber 112 functions as a Helmholz or low frequency resonating chamber that will attenuate a narrow range of low frequency noise that may not be adequately attenuated by other parts of the muffler 10. The particular frequency that will be attenuated will depend upon the volume of the chamber 112, the cross-sectional area of the tube formed by the channels 62 and 92 and the distance between the apertures 64 and 94. In some embodiments, effects of a Helmholz chamber can be achieved even with the apertures 64 and 94 being registered.

Exhaust gas expanding through the aperture 94 and into the downstream external chamber 122 will flow through the aperture 98 and into the downstream return tube formed by channels 66 and 96. This exhaust gas will continue in an upstream direction and into the second gas passage defined by the second channels 30 and 40 of the insert 46. The apertures 44 in the channels 30 and 40 permit a cross-flow of exhaust gas between the internal chamber 58, 88 and the second gas passage 30, 40 of the tri-flow insert 46. Exhaust gas will continue from the insert 46 into the upstream flow tube defined by channels 70 and 100 of the first and second internal plates 16 and 18 respectively. This exhaust gas will be permitted to expand through apertures 72 and 102 and into the upstream external chambers 110 and 120. Exhaust gas will continue into the apertures 76 and 106 of the upstream return tube defined by channels 74 and 104, and into the third gas passage defined by the third channels 32 and 42 of the tri-flow insert 46. Exhaust gas will continue to the outlet tube defined by outlet channels 77 and 107.

Figure 6:
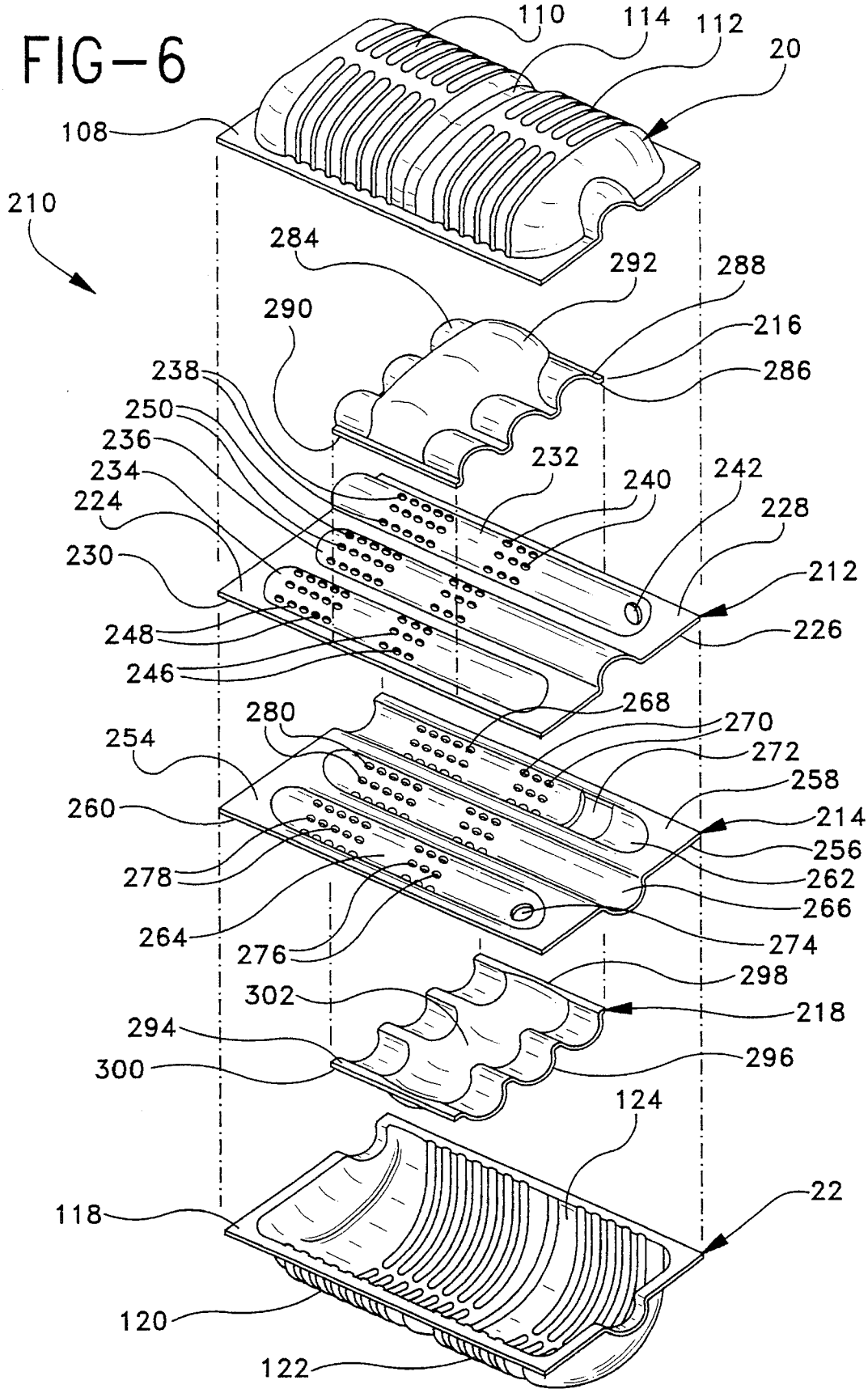
FIG. 6 is an exploded perspective view of an alternate muffler having an external appearance identical to the muffler shown in FIGS. 1 and 2.
Figure 7:
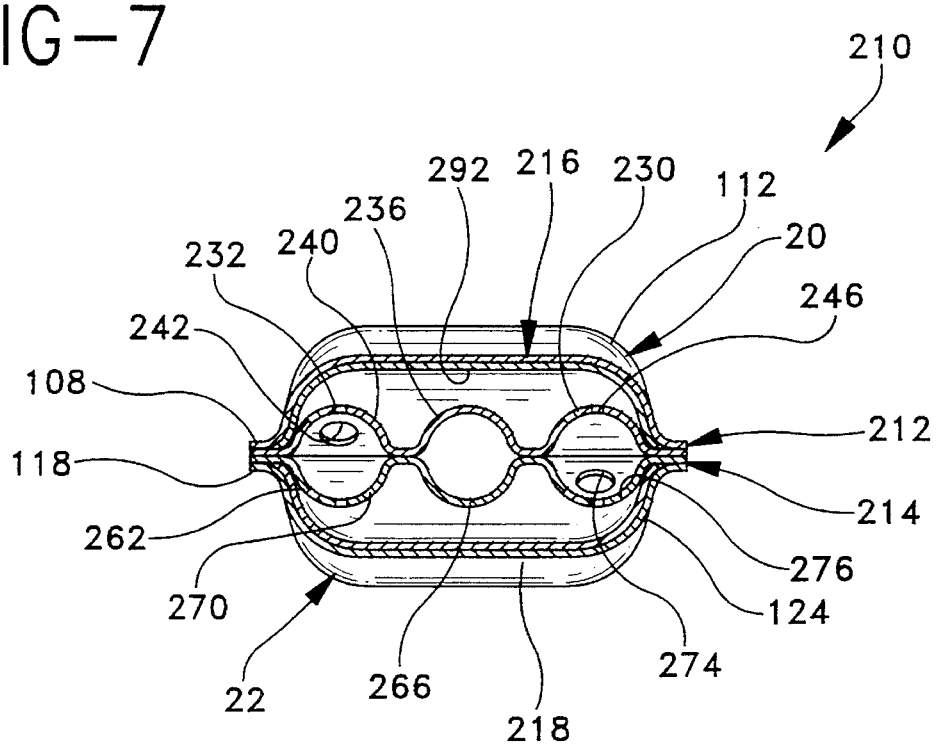
FIG. 7 is a cross-sectional view similar to FIG. 4, but showing the muffler of FIG. 6.
Figure 8:
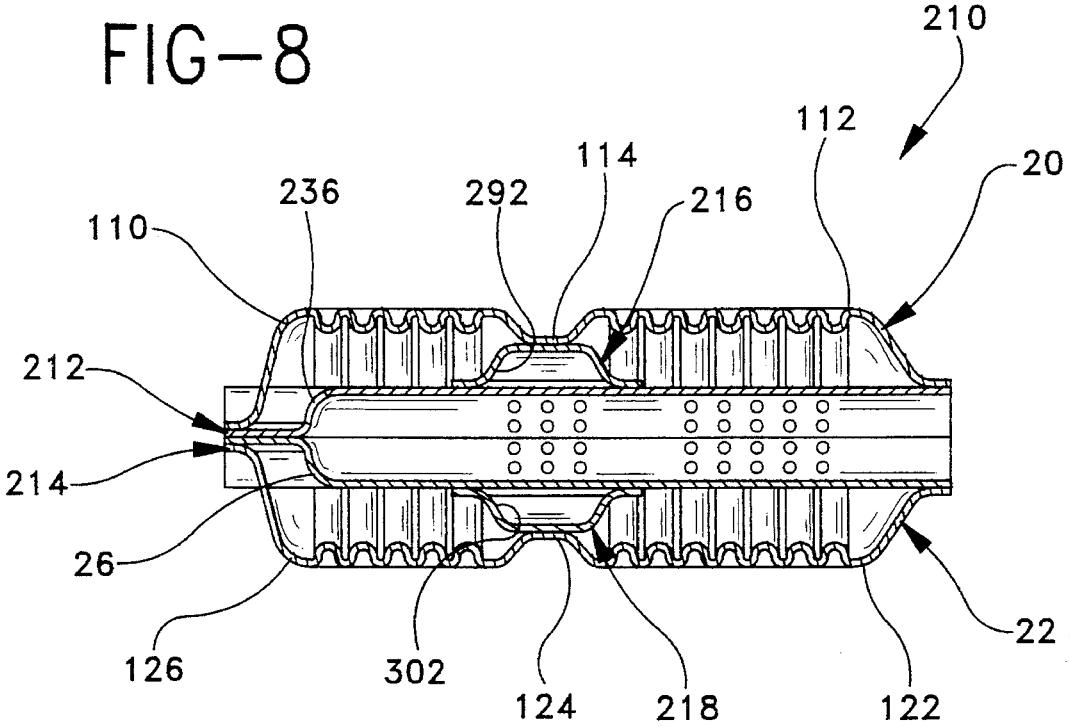
FIG. 8 is a cross-sectional view similar to FIG. 5, but showing the muffler of FIG. 6.

A muffler with an alternate internal construction is illustrated in FIGS. 6–8, and is identified generally by the numeral 210. The muffler 210 includes first and second external shells 20 and 22 which are identical to those on the muffler 10 described and illustrated above. The muffler 210 also includes first and second internal plates 212 and 214, and first and second baffle sheets 216 and 218.

The first internal plate 212 is generally rectangular and includes an upstream end 224, a downstream end 226 and opposed sides 228 and 230 defining a width "W". The first internal plate 212 is formed to define generally parallel channels 232, 234 and 236. The channel 232 is in proximity to the side 228 of the first internal plate 212 and extends from the upstream end 224 to a location near the downstream end 226. The channel 234 is generally adjacent the side 230 of the first internal plate 212 and extends from a location near the downstream end 226 to a location near the upstream end 224. The channel 236 is disposed intermediate the channels 232 and 234 and extends from a location near the upstream end 224 entirely to the downstream end 226.

The channels 232, 234 and 236 have perforations to enable a controlled expansion and/or cross-flow of exhaust gas. In particular, the channel 232 includes a first array of perforations 238 near the upstream end 224, a second array of perforations 240 intermediate the opposed ends 224 and 226 and a single aperture 242 at the downstream end of the channel 232. The channel 234 is substantially free of apertures near its downstream end, but includes an array of apertures 246 at an intermediate location and a second array of apertures 248 near the upstream end. The channel 236 is provided with an array of apertures 250 near the upstream end, but is substantially free of apertures along the remainder of the channel 236 entirely to the downstream end 226 of the first internal plate 212.

The second internal plate 214 is structurally and dimensionally similar to the first internal plate 212. More particularly, the second internal plate 214 includes an upstream end 254, a downstream end 256 and opposed sides 258 and 260. The second internal plate 214 includes generally parallel longitudinally extending channels 262, 264 and 266 which are disposed and dimensioned to register respectively with the channels 232,234 and 236 of the first internal plate 212. The channel 262 extends from the upstream end 254 of the second internal plate 214 to a location near the downstream end 214. The channel 262 includes an array of perforations 268 near the upstream end, a second array of perforations 270 intermediate the opposed ends and a cut-out 272 between the downstream end of channel 262 and the array of perforations 270. The channel 264 is generally adjacent the side 260 of the second internal plate 214 and includes a cut-out 274 near the downstream end 256 of the second internal plate 214. The channel 264 further includes an array of perforations 276 intermediate the opposed ends of the channel 264 and a second array of perforations 278 near the upstream end 254 of the second internal plate 214. The channel 266 is disposed intermediate the channels 262 and 264 and extends from a location near the upstream end 254 of the second internal plate 214 entirely to the downstream end 256 thereof. The channel 266 includes an array of perforations 280 near the upstream end 254.

The first baffle sheet 216 includes an upstream end 284, a downstream end 286 and opposed sides 288 and 290 which define a width "w" which is less than the width "W" of the internal plates 212 and 214. The sides 288 and 290 of the first baffle sheet 216 define peripheral flanges dimensioned to engage portions of the first internal plate 212 between the channels 232 and 234 and the respective sides 228 and 230. The upstream end 284 of the baffle sheet 216 is characterized by arcuate tube mounting portions dimensioned and disposed for nesting with the channels 232,234 and 236 of the first internal plate 212. The downstream end 286 is provided with a similar array of arcuate portions for nesting respectively with the channels of the first internal plate 212. A baffle chamber 292 is defined between the opposed ends 284 and 286 of the first baffle sheet 216. As explained further herein, the baffle chamber 292 is dimensioned and configured to surround portions of the channels 232, 234 and 236 and to engage opposed portions of the first external shell 20.

The second baffle sheet 218 is dimensionally and structurally similar to the first baffle sheet 216. More particularly, the second baffle sheet 218 includes opposed upstream and downstream ends 294 and 296 and opposed sides 298 and 300. The sides 298 and 300 define a width "w" approximately equal to the width "w" of the first baffle sheet 216. Additionally, portions of the second baffle sheet 218 adjacent the sides 298 and 300 form substantially coplanar flanges dimensioned for engagement at locations on the second internal plate 214 between the channels 262 and 264 and the respective sides 258 and 260 of the second internal plate 214. The upstream and downstream ends 294 and 296 of the second baffle sheet 218 are formed with arcuate portions disposed and dimensioned for tight nesting engagement with the channels 262, 264 and 266 of the second internal plate 214. The second baffle sheet 218 further is formed to define a baffle chamber 302.

The muffler 210 is assembled by initially securing the first internal plate 212 in face to face relationship with the second internal plate 214 such that peripheral regions of the plates 212 and 214 are substantially registered. Additionally, the channels 232, 234 and 236 of the first internal plate 212 will register respectively with the channels 262, 264 and 266 of the second internal plate 214 to define an array of substantially parallel tubes.

Assembly of the muffler 10 proceeds by securing the first and second baffle sheets 216 and 218 to the first and second internal plates 212 and 214 respectively. As depicted herein, the first baffle sheet 216 is mounted to the first internal plate 212 such that the baffle chamber 292 encloses the perforations 240 and 246 in the channels 232 and 234 respectively. In this position, the arcuate portions at the upstream and downstream ends 284 and 286 of the baffle sheet 216 will nest tightly with the channels 232, 234 and 236 of the first internal plate 212.

In a similar manner, the second baffle sheet 218 is mounted to the second internal plate 214 such that the baffle chamber 302 encloses the perforations 270 and 276 in the channels 262 and 264 respectively. In this position, the arcuate portions at the upstream and downstream ends 294 and 296 of the second baffle sheet 218 will nest closely with the channels 262, 264 and 266 of the second internal plate 214.

Assembly of the muffler 10 proceeds by securing the first and second external shells 20 and 22 around the assembly of the first and second internal plates 212 and 214 and the first and second baffle sheets 216 and 218. In this assembled condition, peripheral flanges 108 and 118 of the first and second external shells 20 and 22 will register respectively with one another and with peripheral regions of the internal plates 212 and 214. Additionally, the connecting portion 114 of the first external shell 20 will engage the baffled chamber 292 of the baffle sheet 216, and the connecting portion 124 of the second external shell 22 will engage the baffle chamber 302 of the second baffle sheet 216. With this construction, the upstream chamber 110 of the first external shell 20 will be separated from the downstream chamber 112 by the baffle chamber 292 of the baffle sheet 216. Additionally, the upstream chamber 110 will surround the perforation arrays 238, 248 and 250 near the upstream end 224 of the first internal plate 212. Additionally, the downstream chamber 112 of the first external shell 20 will surround the aperture 242 near the downstream end of the channel 232. In a similar manner, the upstream chamber 120 of the second external shell 22 will surround the perforation arrays 268, 278 and 280 near the upstream end 254 of the second internal plate 214. Additionally, the downstream chamber 122 will surround and enclose the apertures 272 and 274 in the channels 262 and 264 near the downstream end 256 of the second internal plate 214.

The muffler 210 functions exactly as the muffler 10 described and illustrated above, and includes the same general gas flow path. The only difference between the muffler 10 and the muffler 210 relates to the relative position of the sheets within the muffler. More particularly, the sheets 12 and 14 of the muffler 10 are disposed between the internal plates 16 and 18, and are formed to define tubes that bridge the internal chamber 58, 88 stamp formed in the internal plates 16 and 18. Conversely, the sheets 216 and 218 of the muffler 210 are disposed between the internal plates and the corresponding external shell. The muffler 210 offers some manufacturing and engineering efficiencies. For example, the draws of metal in the internal plates are substantially shallower and less complex. Additionally, the muffler 210 permits the dimensions of the upstream and downstream chambers to be varied without a complete redesign of the internal plates. In this regard, the sheets defining the baffle chambers of the muffler 210 need merely be moved longitudinally along the internal plates to change the relative dimensions of the upstream and downstream chambers. Redesigns of this type could only require a different array of apertures in the internal plates and perhaps a corresponding change to the location of the connecting portion on each external shell.

The mufflers 10 and 210 provide several significant efficiencies. In particular, the muffler 10 and 210 provide at least one low frequency resonating chamber, at least one high frequency tuning chamber and a plurality of expansion chambers with only six simply formed components that can be assembled in a highly automated environment. This basic design offers options for several modifications. For example, either of the upstream external chambers 110, 120 may function as a second low frequency resonating chamber by providing communication through only one of the formed tubes. Additionally, the relative dimensions of any of the chambers can be varied easily by either changing the shape of the external shells 20, 22 or by changing the relative positions of the internal baffle chambers. Similarly, the degree of communication between the formed tubes and the chambers can be altered by merely changing the size, shapes and locations of the apertures through the tubes. Very simple mufflers with this basic design can be developed by eliminating an external shell so that one of the plates and the associated baffle shell define exterior portions of the muffler. In this latter embodiment, the exteriorly disposed plate would be free of apertures. Other simplifications may include removing one of the baffle shells so that a much larger expansion chamber is provided between one of the internal plates and the opposed external shell 20.

While the invention has been described with respect to a preferred embodiment, it is apparent that various changes can be made without departing from the scope of the invention as defined by the appended claims.

I claim:

1. An exhaust muffler comprising:

a first plate, a second plate secured in face-to-face relationship with said first plate and a sheet secured to said first plate, said plates and said sheet being formed to define internal gas passages therebetween, said gas passages including an internal chamber and a plurality of tubes communicating with said internal chamber, said tubes including at least one inlet to the muffler and at least one outlet from the muffler, a plurality of said tubes being formed with perforation means therethrough for permitting gas communication between said tubes and portions of said muffler surrounding said tubes; and an external shell having a peripheral flange secured to peripheral regions of said first plate and being formed to define at least one external chamber secured to said internal chamber and enclosing and communicating with portions of said tubes formed my said first plate.

2. The muffler of claim 1, wherein said sheet is a first sheet of said muffler, and wherein said muffler further comprises a second sheet secured to said second plate, said second sheet being formed to define portions of said internal gas passages of said muffler.

3. The muffler of claim 2, wherein said external shell is a first external shell, and wherein said muffler further comprises a second external shell having a peripheral flange secured to said second plate and being formed to define at least one external chamber surrounding and secured to portions of said internal chamber and surrounding and communicating with portions of said tubes defined by said second plate.

4. The muffler of claim 3, wherein said first and second plates are formed to define said internal chamber, a plurality of said tubes being formed by said first and second plates, said first and second sheets being secured in face-to-face relationship with one another and being formed to define a plurality of said tubes of said muffler, said first and second sheets being disposed intermediate said first and second plates such that the tubes defined by said first and second sheets extend across said internal chamber, at least one tube formed by said first and second sheets being formed with perforation means therein for permitting communication between said tubes formed by said sheets and said internal chamber.

5. The muffler of claim 4, wherein the muffler includes an upstream end having said inlet and a downstream end having said outlet, said internal chamber being intermediate said upstream and downstream ends of said muffler, said first and second external shells defining upstream chambers intermediate said internal chamber and said upstream end of said muffler and downstream chambers intermediate said internal chamber and said downstream end of said muffler.

6. The muffler of claim 5, wherein said plurality of tubes formed by said first and second plates include an outlet tube extending from said internal chamber to said outlet of said muffler, said outlet tube being free of perforations, said tubes formed by said sheets including a tube free of perforations extending across said internal chamber and to said outlet tube.

7. The muffler of claim 6, wherein the plurality of tubes formed by said first and second plates includes an inlet tube extending from said inlet of said muffler to said internal chamber, said first and second sheets defining a perforated tube extending through said internal chamber and communicating with said inlet tube.

8. The muffler of claim 3, wherein said first and second plates are disposed intermediate said first and second sheets, said first and second sheets being formed to define said internal chamber surrounding portions of said tubes formed by said internal plates, portions of said tubes formed by said internal plates having said perforation means disposed within said internal chamber.

9. The muffler of claim 8, wherein said muffler defines an upstream end having said inlet to said muffler and an opposed downstream end having said outlet of said muffler, said sheets being secured to said plates at locations intermediate said upstream and downstream ends of said muffler such that said external shells define upstream external chambers between said upstream end and said internal chamber and downstream external chambers between said downstream end and said internal chamber.

10. The muffler of claim 9, wherein said first and second plates are formed to define registered downstream flow channels extending from said internal chamber toward said downstream end of said muffler and registered downstream return channels extending from said internal chamber toward said downstream end of said muffler, portions of said first plate defining said downstream flow channel having an aperture therethrough for communication with said downstream external chamber defined by said first external shell, remaining portions of said first plate enclosed by said downstream external chamber being free of perforations, such that said downstream external chamber formed by said first external shell functions as a low frequency resonating chamber, said downstream flow channel and said downstream return channel formed by said second plate having perforation means therein for permitting communication with said downstream external chamber formed by said second external shell.

11. The muffler of claim 10, wherein said tubes formed by said first and second plates comprise an outlet tube extending from said internal chamber to said outlet of said muffler and passing through said downstream external chambers defined by said first and second external shells, said outlet tube being free of perforations.

12. The muffler of claim 11, wherein the perforation means through the downstream flow channel of said second plate is disposed intermediate said internal chamber and said aperture through said downstream flow channel of said first plate, such that portions of the tube defined by said downstream flow channels and disposed intermediate said aperture means in said second plate and said aperture in said first plate functions as a tuning tube communicating with said low frequency resonating chamber.

13. The muffler of claim 11, wherein portions of said tubes disposed in said upstream external chambers are perforated for permitting expansion of exhaust gas from said tubes.

14. The muffler of claim 3, wherein said muffler includes an upstream end having said inlet and an opposed downstream end having said outlet, said internal chamber being disposed intermediate said upstream and downstream ends such that said external shells define upstream external chambers between said internal chamber and said upstream end of said muffler and downstream chambers between said internal chamber and said downstream end of said muffler.

15. An exhaust muffler comprising:

first and second plates secured in face-to-face relationship and formed to define a plurality of tubes therebetween, said tubes including an inlet to the muffler and an outlet from the muffler, selected tubes being formed with aperture means therethrough for permitting expansion of exhaust gas;

first and second sheets secured respectively to said first and second plates, each said sheet being formed to define an internal chamber surrounding and enclosing selected aperture means in said tubes; and first and second external shells secured respectively to said first and second plates and formed to enclose said tubes and said internal chambers.

16. The muffler of claim 15, wherein the muffler has opposed upstream and downstream ends, said internal chambers being spaced from said upstream and downstream ends, said first and second external shells being secured respectively to said internal chambers of said first and second sheets such that said internal chambers define baffles dividing each of first and second external shells into upstream and downstream external chambers.

17. The muffler of claim 16 wherein at least one tube in each of said upstream and downstream external chambers includes said aperture means for permitting exhaust gas communication between said tubes and the respective upstream and downstream external chambers.

18. An exhaust muffler comprising:

first and second sheets secured in face-to-face relationship and formed to define a plurality of tubes therebetween, selected tubes formed by said sheets being provided with aperture means extending therethrough for permitting expansion of exhaust gas;

first and second plates each having opposed upstream and downstream ends and each being formed to include an internal chamber intermediate said ends of said respective first and second plates, each said plate being formed to define a plurality of channels extending from said internal chamber toward said upstream end and a plurality of channels extending from said internal chamber toward said downstream end, said plates being secured in face-to-face relationship with one another and around said sheets such that the tubes formed by said sheets bridge said internal chamber formed by said plates, and such that said channels formed in said plates define tubes communicating with the tubes formed by said sheets, said tubes formed by said plates including an inlet to the muffler and an outlet from the muffler, a plurality of said tubes formed by said plates having at least one aperture therethrough; and first and second external shells secured to said first and second plates respectively, each said external shell formed to define upstream and downstream external chambers and a connecting portion therebetween, said connecting portion of said first and second external shells engaging the internal chamber formed by the respective first and second plates, such that the internal chamber of each of said first and second plates separates said upstream and downstream chambers of the respective first and second external shells from one another.

19. A stamp formed muffler comprising first and second plates secured in face-to-face relationship with one another and formed to define a plurality of tubes therebetween, said tubes including an inlet tube defining an inlet to the muffler, an outlet tube defining an outlet from the muffler, a first flow tube communicating with said inlet and a second flow tube communicating with said outlet, said first and second plates each having at least one aperture through portions defining said first flow tube, said first plate being free of apertures on portions defining said second flow tube and said second plate having at least one aperture through portions defining said second flow tube; and first and second external shells secured respectively to said first and second plates, said first external shell being formed to define a low frequency resonating chamber surrounding portions of said first and second flow tubes defined by said first external shell, said second plate being formed to define an expansion chamber surrounding portions of said second plate defining said first and second flow tubes, such that said expansion chamber provides communication between said first flow tube and said second flow tube.

20. The muffler of claim 19, wherein the aperture through portions of said second plate defining said first flow tube is disposed intermediate said inlet tube and the aperture in the portions of said first plate defining said first flow tube, such that portions of said first flow tube between the aperture and the first plate and the aperture in the second plate define a tuning tube communicating with the low frequency resonating chamber.

21. The muffler of claim 19, wherein said plates define at least one additional tube providing the communication between the second flow tube and the outlet tube of the muffler.

22. The muffler of claim 20, further comprising first and second sheets formed respectively to define first and second internal chambers, said first and second sheets being secured respectively to said first and second plates such that the first and second internal chambers surround selected portions of the tubes formed by said first and second plates, at least one tube surrounded by said internal chamber having perforations therethrough for permitting expansion of exhaust gas from said tube.

23. The muffler of claim 22, wherein said first and second external shells define connecting portions secured respectively to said first and second internal chambers, such that said first and second internal chambers divide the respective first and second external shells into upstream and downstream external chambers.

* * * * *